US005728668A

United States Patent [19]

Thomas et al.

[11] Patent Number: 5,728,668

[45] Date of Patent: Mar. 17, 1998

[54] CLEANING COMPOSITION

[75] Inventors: Barbara Thomas, Princeton, N.J.; Guy Broze, Grace-Hollogne, Belgium

[73] Assignee: Colgate Palmolive Company, Piscataway, N.J.

[21] Appl. No.: 667,290

[22] Filed: Jun. 12, 1996

Related U.S. Application Data

[63] Continuation-in-part of Ser. No. 517,273, Aug. 21, 1995, abandoned, which is a continuation-in-part of Ser. No. 355,470, Dec. 14, 1994, abandoned.

[51] Int. Cl.[6] ..... C11D 1/02; C11D 1/62; C11D 3/28

[52] U.S. Cl. ..... 510/237; 510/246; 510/259; 510/433; 510/504

[58] Field of Search ..... 510/237, 246, 510/259, 433, 504

[56] References Cited

U.S. PATENT DOCUMENTS

| | | | |
|---|---|---|---|
| 4,276,186 | 6/1981 | Bakos et al. | 252/158 |
| 4,428,871 | 1/1984 | Ward et al. | 252/542 |
| 4,592,856 | 6/1986 | Kobayashi | 252/162 |
| 4,744,834 | 5/1988 | Haq | 134/38 |
| 4,834,903 | 5/1989 | Roth et al. | 252/174.17 |
| 5,110,494 | 5/1992 | Beck | 252/156 |
| 5,151,223 | 9/1992 | Maaser | 252/547 |
| 5,411,585 | 5/1995 | Avery et al. | 100/287.1 |

*Primary Examiner*—Christine Skane
*Assistant Examiner*—Gregory R. DelCotto
*Attorney, Agent, or Firm*—Richard E. Nanfeldt; James Serafino

[57] ABSTRACT

An pre-spotting composition which comprises by weight percent of about 0.1 to about 15 wt. % of $[(R)_3N^+R'(OH)^-]$ wherein R is a methyl or ethyl group, R' is an alkyl or ethoxylated alkyl group having about 10 to about 20 carbon atoms and water and optionally an alkali metal silicate, a cyclic nitrogen containing compound; an alknolamine; and a surfactant.

7 Claims, No Drawings

CLEANING COMPOSITION

RELATED APPLICATION

This application is a continuation in part application of U.S. Ser. No. 8/517,273 filed Aug. 21, 1995, now abandoned which in turn is a continuation in part application of U.S. Ser. No. 355,470 filed Dec. 14, 1994, now abandoned.

FIELD OF THE INVENTION

This invention relates to aqueous cleaning compositions in the form of liquids, sprays, gels and pastes, which remove dried-on and cooked-on food and other difficult-to-remove soils from kitchen utensils, flatware, dishes, glassware, cookware, bakeware, cooking surfaces, and surrounding areas in a convenient, easy, timely, and mild manner.

Of the difficult-to-remove soils, the most severe is the baked and/or burned-on (especially when reheated and/or allowed to build up over time). Soil categories include grease, meat (including skin), dairy, fruit pie filling, carbohydrate, and starch. Soiled substrate categories include aluminum, iron, stainless steel, enamel, Corningware, Pyrex, and other glass cookware.

BACKGROUND OF THE INVENTION

Current light duty liquid detergents are dramatically deficient in these areas. The consumer has to soak soiled items for long periods of time in these solutions, and then use harsh cleaning methods (scouring with steel wool or scouring cleanser) to remove the remaining soil.

To speed up the process and increase efficacy of cleaning these soils, the consumer will resort to heat, scraping, and harsh chemicals (e.g. caustic oven cleaners).

Deficiencies in these cleaning methods include time consumption for soaking and scouring, physical effort required for scouring and scraping, irritation to hands from harsh cleaning chemicals and methods, damage to objects from harsh chemicals and methods, unpleasant fumes and odors, and danger from heated solutions. Though non-caustic cleaners are listed in the literature, none are directed to the aqueous cleaning compositions of the present invention.

SUMMARY OF THE INVENTION

The pre-spotting aqueous cleaning compositions of the present invention comprises a tetraalkyl ammonium hydroxide and water and optionally an alkali metal silicate, a cyclic nitrogen containing compound, an alkanolamine, and a surfactant. These compositions may be formulated as clear, single-phase aqueous liquids, gels, or pastes and dispensed from bottles, squeeze bottles, or paste dispensers. It has been found that applying the caustic-free aqueous compositions of the present invention to soiled surfaces removes the above mentioned soils at ambient temperature in a relatively short period of time (from 10 to 60 minutes) without need for heat, long soaking times, scouring, or harsh chemicals.

Removal of baked-on food from cookware, ovens and other household surfaces is a difficult problem for consumers. This is especially true of baked-on fats and oils which form a thin varnish like layer that adheres strongly to the surface. Removal of this kind of soil often requires extreme techniques such as scrubbing with steel wool and harsh cleaners (pH≧13–14).

However, it has been discovered that polymerized fats contain ester bonds which are susceptible to hydrolysis by hydroxide ion. Molecules of the type $[(R)_3N^+(R')X^-]$ (R, R'=alkyl, X=halide) have been used in organic synthesis as phase transfer catalysts because they have the ability to carry water insoluble anions such as $OH^-$ into nonaqueous solution. This permits delivery of $OH^-$ to the hydrophobic surface of baked-on fat soils.

The $[(R)_3N^+(R')OH^-]$, R=$CH_3$, R'=tallow is prepared by ion exchange of the corresponding $Cl^-$ salt using amberlite IRA-400 (OH) ion exchange resin in either methanol or water. Preparation in methanol yields the hydroxide salt completely free of chloride but a small amount of methanol remains in the sample.

Solutions of $[(R)_3N^+(R')OH^-]$, R=$CH_3$, R'=tallow, approximately 0.5 wt. % and 1.0 wt. % were tested on Crisco shortening baked for 10 hours at 350° F. on stainless steel to determine the efficacy on baked-on soil removal. The solutions were allowed to soak on the soil for 16 hours. Both of these systems showed superior performance to a 1.0 wt. % solution of the corresponding chloride salt adjusted to an equivalent pH. This clearly demonstrates the ability of $[(R)_3N^+(R')OH^-]$, R=CH3, R'=tallow to "carry" hydroxide ion directly to the soil surface allowing superior performance at moderate pH.

The $[(R)_3N^+(R')OH^-]$ salt delivers hydroxide ion specifically to the soil surface through hydrophobic interactions between the soil and the tallow tail. This allows effective soil removal at lower pH, 12.2 vs. 14 with a lower level of active alkalinity.

The aqueous oven cleaning compositions according to the present invention comprise approximately by weight percent:

(a) from about 0.1 to 15%, and preferably 0.2 to 10%, of a tetraalkyl ammonium hydroxide having the formula $[(R)_3N^+(R')OH^-$ wherein R equals an ethyl or methyl group and R' is an alkyl group having about 10 to about 20 carbon atoms;

(b) 0 to 15% of a surfactant selected from the group consisting of anionic surfactants and nonionic surfactants and mixtures thereof;

(c) 0 to about 10% of a builder selected from the group consisting of polyphosphates, pyrophosphates, silicates, citrates and carbonates and mixtures thereof;

(d) about 0 to about 4% of an amine selected from the group consisting of monoethanolamine, diethanolamine and triethanolamine and mixtures thereof;

(e) about 0 to about 25% of a cyclic nitrogen containing compound such as imidazole;

(f) 0 to 6 wt. %, more preferably 0.1 to 6 wt. % of a water soluble cosolvent such as diethylene glycol monobutyl ether and ethylene glycol monobutyl ether; and (g) the balance being water, wherein the aqueous composition does not contain any organosilane compound containing a hydrolyzable group, any organic quaternary ammonium chloride compounds, any halogenated hydrocarbon solvents, and any polyglycol such as polyethylene glycol having a molecular weight of 200 to 600.

It has now been found that the problem of removing cooked-on and dried-on food residues from ovens can be resolved by applying at a temperature of about 25° C. to about 40° C. thereto for a relatively short time (10–30 minutes) the aqueous pre-spotting composition of the present invention.

In accordance with the invention, the removal of cooked-on soils is thus effected by: contacting the soiled surface with an effective amount of the above-identified pre-spotting compositions; allowing an effective amount of time (at least about 10 minutes) for the composition to soak through the soil; and then rinsing the affected soiled surfaces to remove the pre-spotting composition and the loosened soil.

DETAILED DESCRIPTION OF THE INVENTION

The pre-spotting compositions of this invention are comprised of the following components: a tetraalkyl ammonium hydroxide having the formula $[(R)_3N^+R'(OH)^-]$ wherein R is an ethyl or methyl group and R' is an alkyl group having about 10 to 20 carbon atoms, preferably about 10 to 16 carbon atoms such as a coco, tallow, cetyl, lauryl or ethoxylated group, optionally, a surfactant, optionally, an alkanolamine, optionally, an imidazole, water, optionally, a solvent, and optionally a builder. In addition to the above ingredients, the compositions of this invention may contain other substances generally present in detergent compositions. Foam stabilizing agents may be incorporated at a concentration of 0.1 to 5 wt. %, and other ingredients which may normally be present at a concentration of 0.1 to 5 wt. % include preservatives, humectants, foam boosters, antifoaming agents, dispersants, pH modifiers, colorants, and perfumes.

The surfactant, which is present in the composition in the amount of about 0 to about 15 wt. %, more preferably 0.1 to 10 weight %, is selected from the group consisting of nonionic surfactants anionic surfactants and mixtures thereof. Preferably, the surfactant is present in the amount of 1 to 7 wt. %.

The nonionic surfactant, preferably, is comprised of one or a mixture of primary alcohol ethoxylates or secondary alcohol ethoxylates or alkyl phenol ethoxylates. The primary alcohol ethoxylates are represented by the general formula:

$$R—O—(CH_2—CH_2—O)_n—H$$

wherein R is an alkyl radical having from 9 to 16 carbon atoms and the number of ethoxylate groups, n, is from 5 to 12. Commercially available nonionic surfactants of this type are sold by Shell Chemical Company under the tradename Neodol and by Union Carbide Corporation under the tradename Tergitol.

The secondary alcohol ethoxylates are represented by the general formula:

$$\begin{array}{l} CH_3—(CH_2)_x—CH—(CH_2)_y—CH_3 \\ \qquad\qquad\quad | \\ \qquad\qquad\quad O \\ \qquad\qquad\quad | \\ \qquad\qquad\quad (CH_2—CH_2—O)_n—H) \end{array}$$

Wherein x+y is from 6 to 15 and the number of ethoxylate groups, n, is from 5 to 12. Commercially available surfactants of this type are sold by Union Carbide Corporation under the tradename Tergitol S series surfactants, with Tergitol 15-S-9 (T 15-S-9) being preferred for use herein.

The alkyl phenol ethoxylates are represented by the general formula:

$$R—(phenyl)—O—(CH_2—CH_2—O)_n—H$$

where the number of ethoxylate groups, n, is from 8 to 15, and R is an alkyl radical having 8 or 9 carbon atoms. Commercially available nonionic surfactants of this type are sold by Rohm and Haas Company under the tradenames Triton N and Triton X series.

The anionic surfactant is preferably selected from the group consisting of paraffin sulfonate, alkyl sulfate, alkyl ethoxy sulfate, or alkyl benzene sulfonates, such as sodium linear tridecyl or dodecyl benzene sulfonate, sodium and/or ammonium alcohol ethoxy sulfate (AEOS), sodium lauroyl, cocoyl or myristoyl sarcosinate or a combination thereof.

Alkylpolysaccharides surfactants which are also useful alone or in conjunction with the aforementioned surfactants and have a hydrophobic group containing from about 8 to about 20 carbon atoms, preferably from about 10 to about 16 carbon atoms, most preferably from 12 to 14 carbon atoms, and polysaccharide hydrophilic group containing from about 1.5 to about 10, preferably from 1.5 to 4, and most preferably from 1.6 to 2.7 saccharide units (e.g., galactoside, glucoside, fructoside, glucosyl, fructosyl, and/or galactosyl units). Mixtures of saccharide moieties may be used in the alkylpolysaccharide surfactants. The number x indicates the number of saccharide units in a particular alkylpolysaccharide surfactant. For a particular alkylpolysaccharide molecule x can only assume integral values. Any physical sample can be characterized by the average value of x and this average value can assume non-integral values. In this specification the values of x are to be understood to be average values. The hydrophobic group (R) can be attached at the 2-, 3-, or 4-positions rather than at the 1-position, (thus giving e.g. a glucosyl or galactosyl as opposed to a glucoside or galactoside). However, attachment through the 1-position, i.e., glucosides, galactosides, fructosides, etc., is preferred. In the preferred product the additional saccharide units are predominately attached to the previous saccharide unit's 2-position. Attachment through the 3-, 4-, and 6-positions can also occur. Optionally and less desirably there can be a polyalkoxide chain joining the hydrophobic moiety (R) and the polysaccharide chain. The preferred alkoxide moiety is ethoxide.

Typical hydrophobic groups include alkyl groups, either saturated or unsaturated, branched or unbranched containing from about 8 to about 20, preferably from about 10 to about 16 carbon atoms. Preferably, the alkyl group is a straight chain saturated alkyl group. The alkyl group can contain up to 3 hydroxy groups and/or the polyalkoxide chain can contain up to about 30, preferably less than 10, most preferably 0, alkoxide moieties.

Suitable alkyl polysaccharides are decyl, dodecyl, tetradecyl, pentadecyl, hexadecyl, and octadecyl, di-, tri-, tetra-, penta-, and hexaglucosides, galactosides, lactosides, fructosides, fructosyls, lactosyls, glucosyls and/or galactosyls and mixtures thereof.

The alkyl monosaccharides are relatively less soluble in water than the higher alkylpolysaccharides. When used in admixture with alkylpolysaccharides, the alkylmonosaccharides are solubilized to some extent. The use of alkylmonosaccharides in admixture with alkylpolysaccharides is a preferred mode of carrying out the invention. Suitable mixtures include coconut alkyl, di-, tri-, tetra-, and pentaglucosides and tallow alkyl tetra-, penta-, and hexaglucosides.

The preferred alkylpolysaccharides are alkylpolyglucosides having the formula:

$$RO(C_nH_{2n}O)_r(Z)_x$$

wherein Z is derived from glucose, R is a hydrophobic group selected from the group consisting of alkyl, alkylphenyl, hydroxyalkylphenyl, and mixtures thereof in which said alkyl groups contain from about 10 to about 18, preferably from 12 to 14 carbon atoms; n is 2 or 3 preferably 2, r is from 0 to about 10, preferable 0; and x is from 1.5 to about 8, preferably from 1.5 to 4, most preferably from 1.6 to 2.7. To prepare these compounds a long chain alcohol (ROH) can be reacted with glucose, in the presence of an acid catalyst to form the desired glucoside. Alternatively the alkylpolyglucosides can be prepared by a two step procedure in which a short chain alcohol ($C_{1-6}$) is reacted with glucose or a polyglucoside (x=2 to 4) to yield a short chain alkyl glucoside (x=1 to 4) which can in turn be reacted with a longer chain alcohol (ROH) to displace the short chain alcohol and obtain the desired alkylpolyglucoside. If this two step procedure is used, the short chain alkylglucoside content of the final alkylpolyglucoside material should be less than 50%, preferably less than 10%, more preferably less than 5%, most preferably 0% of the alkylpolyglucoside.

The amount of unreacted alcohol (the free fatty alcohol content) in the desired alkylpolysaccharide surfactant is preferably less than about 2%, more preferably less than about 0.5% by weight of the total of the alkylpolysaccharide. For some uses it is desirable to have the alkylmonosaccharide content less than about 10%.

The used herein, "alkylpolysaccharide surfactant" is intended to represent both the preferred glucose and galactose derived surfactants and the less preferred alkylpolysaccharide surfactants. Throughout this specification, "alkylpolyglucoside" is used to include alkyl- polyglycosides because the stereo chemistry of the saccharide moiety is changed during the preparation reaction.

An especially preferred APG glycoside surfactant is APG 625 glycoside manufactured by the Henkel Corporation of Ambler, Pa. APG 25 is a nonionic alkylpolyglycoside characterized by the formula:

$$C_nH_{2n+1}O(C_6H_{10}O_5)_xH$$

wherein n=10(2%); n=12(65%); n=14(21–28%); n=16 (4–8%) and n=18(0.5%) and x(degree of polymerization)= 1.6. APG 625 has: a pH of 6–8(10% of APG 625 in distilled water); a specific gravity at 25° C. of 1.1 grams/ml; a density at 25° C. of 9.1 kgs/gallons; a calculated HLB of about 12.1 and a Brookfield viscosity at 35° C., 21 spindle, 5–10 RPM of about 3,000 to about 7,000 cps. Mixtures of two or more of the liquid nonionic surfactants can be used and in some cases advantages can be obtained by the use of such mixtures.

The composition also contains about 0 to about 10 weight % of a builder salt or electrolyte, which is comprised of phosphates such as tetrapotassium pyrophosphate; sodium tripolyphosphate; carbonates such as sodium carbonate; sodium sesquicarbonate and sodium bicarbonate; sodium gluconate; citrates such as sodium citrate; and sodium ethylene diamine tetraacetate. The preferred amount of the builder in the composition is about 0.5 to about 5 wt. %.

The composition contains about 0 to 25 wt. %, more preferably 0.1 to 10 wt. %, of a penetrant which is a cyclic nitrogen containing compound such as pyrrolidine, pyridine, 2-pyrrolidine, N-methyl, 2-pyrrolidone, imidazole, morpholine, and diethylenetriamine, wherein the preferred cyclic nitrogen containing compounds are imidazole and 4-methylimidazone. Imidazole is especially preferred. Triethylenediamine or 1,4-diaza bicylco [2,2,2] octane also works as a penetrant in the instant composition.

Also present in the composition is 0 to about 4 wt. % of an amine. This amine comprises an alkanolamine, namely monoethanolamine, diethanolamine or triethanolamine. About 0 to about 1.0, more preferably 0.1 to 0.6 wt. % of the alkanolamine in the composition is preferred.

The alkali metal silicate can be optionally present in the composition at a concentration of 0 to 50 wt. %, more preferably about 5 to about 45 wt. % and most preferably about 10 to about 40 wt. %. The alkali metal silicates are preferably sodium silicate and/or potassium silicate. The potassium silicate is characterized by the formula $K_2OXSiO_2$ wherein x>2.10 and the potassium silicate has a water content of less than 66 wt. %. The sodium silicate is characterized by the formula $Na_2OXSiO_2$ wherein x>2.88 and the sodium silicate has a water content of less than 61 wt. %. Water completes the balance of the composition and the pH of the composition is about 11 to about 13.

The compositions of this invention are prepared by adding with stirring in a suitable mixer and homogenizer at a temperature of about 15° C. to about 30° C. an aqueous solution of the tetraalkyl ammonium hydroxide, imidazole and/or alkanolamine to an aqueous solution of a surfactant and alkali metal silicate selected from the group consisting of lithium silicate, sodium silicate and potassium silicate, wherein the alkali metal silicate is in an aqueous solution at a concentration of about 30 wt. % to about 60 wt. %.

The instant compositions do not contain metal hydroxides; however, the instant compositions may contain alkali metal halides such as lithium chloride, sodium chloride and potassium chloride in an amount of about 0.1 to about 15 wt. % and an organic compound of the formula:

$$C_nH_{2n+2-x}(OH)_x$$

wherein x=1, 2 or 3 and n is about 2 to about 8 and the concentration of the organic compound is about 0 to about 15 wt. %, 0.1 to about 15 wt. %. Also suitable as structuring agents are nonionic surfactants containing a hydroxyl group.

The following examples will serve to illustrate the present invention without being deemed limitative thereof. Parts and percents are by weight unless otherwise indicated.

EXAMPLE 1

Formulations (in wt. %) of the following ingredients are prepared:

TABLE I

| | A | B | C |
|---|---|---|---|
| $(R)_3N^+(R')OH^-$, R = $CH_3$; R' = tallow | 0.5 | 1.0 | 0 |
| Water | 99.5 | 99.0 | 99.0 |
| $R_3N^+(R')Cl^-$, R = $CH_3$; R' = tallow | 0 | 0 | 1.0 |
| pH | 12.2 | 12.6 | 12.2 |
| % soil removal | 69 | 89 | 12 |

The solutions were prepared by simple mixing at R.T. the water and the tetraalkyl ammonium hydroxide or chloride.

These formulations were tested on Crisco shortening baked at 350° F. for 10 hours on a 2 inch pyrex petri dishes. Approximately 4 g of each formula was used and the soil was soaked at room temperature for 16 hours. The formulations were then rinsed off with tap water and light rubbing to remove loosened soil. Percent soil removal was determined gravimetrically. Three replicates were run for each formula.

EXAMPLE 2

Formulations (in wt. %) of the following ingredients were prepared:

| | D | E |
|---|---|---|
| $(R)_3N^+(R')OH^-$ R = $CH_3$; R' = $C_{14}H_{29}$ | 1.0 | 0.0 |
| $(R)_3N^+(R')OH^-$ R = $CH_3$; R' = tallow | 0.0 | 1.0 |
| NaLAS | 2.0 | 2.0 |
| Diethyleneglycol Monobutyl Ether | 5.0 | 5.0 |
| Perfume | 0.2 | 0.2 |
| Deionized water | bal. | bal. |

These formulations were tested on 80% lean ground beef baked at 350° F. for 45 minutes on 2 inch pyrex petri dishes and 2 inch stainless steel planchettes. Approximately 6 g of ground beef was placed on each substrate. After baking, each patty was removed and the substrates were then weighed before and after cleaning. Approximately 2 g of each formula was used and the soil was soaked at room temperature for 5 minutes. The formulations were then rinsed off with with 80°–90° F. tap water. Percent soil removal was determined gravimetrically. Three replicates were run for each formula. Two commercial formulations were also tested: Fantastic All Purpose Cleaner was used as purchased and a solution of 1% Palmolive Dishwashing Liquid was diluted to 1% with tap water was also tested. Results are shown below.

% Soil Removal

| Formula | Hamburger on Pyrex | Hamburger on Stainless |
|---|---|---|
| D | 50 | 62 |
| E | 61 | 66 |
| 1% Palmolive | 25 | 19 |
| Fantastic | 34 | 20 |

What is claimed is:

1. A baked-on soil prespotting aqueous cleaning composition which consists of by weight percent:

(a) 5 to about 45 of an alkali metal silicate;

(b) 0.1 to about 10 of a cyclic nitrogen containing compound, (c) 0.1 to about 0.6 of an alkanolamine;

(d) 0.1 to 10 of at least one anionic surfactant;

(e) 0.1 to about 15.0 of $(R_3)N^+R'(OH^-)$, wherein R is methyl or ethyl group and R' is an alkyl or ethoxylated alkyl group having about 10 to about 20 carbon atoms;

(f) 0.1 to 15 of an organic compound of the formula $C_nH_{2n+2-x}(OH)_x$ wherein x=1, 2 or 3 and n is 2 to 8; and (g) the balance being water.

2. The composition of claim 1, wherein said alkali metal silicate is selected from the group consisting of lithium silicate, sodium silicate and potassium silicate and mixtures thereof.

3. The composition of claim 2, wherein said alkanolamine is selected from the group consisting of a monoethanol amine, diethanolamine and triethanolamine and mixtures thereof.

4. The composition of claim 3, further including a builder salt.

5. The composition of claim 1 which is effective at ambient temperature.

6. The composition of claim 1, wherein said cyclic nitrogen containing compound is imidazole or 4-methylimidazole.

7. The composition of claim 1 further including an alkali metal halide.

* * * * *